United States Patent [19]

Benford

[11] 3,989,329

[45] Nov. 2, 1976

[54] REFRIGERATION APPARATUS ENCLOSURE STRUCTURE

[75] Inventor: Arthur E. Benford, Evansville, Ind.

[73] Assignee: Whirlpool Corporation, Benton Harbor, Mich.

[22] Filed: Aug. 4, 1975

[21] Appl. No.: 601,636

Related U.S. Application Data

[62] Division of Ser. No. 433,071, Jan. 14, 1974.

[52] U.S. Cl. ..... 312/214; 220/9 F; 52/631; 62/DIG. 13

[51] Int. Cl.[2] ..... B65D 25/14; F25D 23/06

[58] Field of Search..... 312/214, 236, 245; 220/9 F; 62/273

[56] References Cited

UNITED STATES PATENTS

| | | | |
|---|---|---|---|
| 2,317,775 | 4/1943 | King | 312/236 |
| 2,493,958 | 1/1950 | Foerstner | 312/236 |
| 2,576,665 | 11/1951 | Bixler | 62/273 |
| 2,779,066 | 1/1957 | Gaugler et al. | 312/214 |
| 3,014,611 | 12/1961 | Marshall | 220/9 F |
| 3,367,492 | 2/1968 | Pratt et al. | 220/9 F |
| 3,910,658 | 10/1975 | Lindenschmidt | 312/214 |
| 3,913,996 | 10/1975 | Benford | 312/214 |

*Primary Examiner*—Casmir A. Nunberg
*Assistant Examiner*—Victor N. Sakran
*Attorney, Agent, or Firm*—Wegner, Stellman, McCord, Wiles & Wood

[57] ABSTRACT

A refrigeration apparatus enclosure and method of forming the same wherein an inner laminate wall is provided in an outer cabinet for providing the sheet liner and insulation portions of the refrigeration apparatus enclosure. The laminate wall is folded along lines cut through the insulation to conform to the configuration of the outer cabinet and insulation is provided for filling the resultant voids to complete the enclosure construction. The voids are filled by foamed-in-place plastic which may further serve to bond the laminate wall to the outer cabinet. The rear wall of the cabinet may comprise a flat laminate wall and a divider wall may be provided within the cabinet for dividing the space therein into separate compartments. The divider wall may comprise another laminate wall.

9 Claims, 9 Drawing Figures

5
10
16
15
12
17
5
17
11
18
70
13
9
19
14

28
31
32
CUT
FOLD
15
29
30
33
34
FOLD
CUT
29
30
15

23
20
4

25
39
26
13
21
38
21
40
22
41
39
56
41
36
9
8
27
29
35
4
37
40
30
41
15
41

44
41
23
40
21
36
12
38
49
48
50
25
24
40
11
37
42
40
35
44
41
27
6.

60
13

42
45
26
29
46
29
38
60
59
57
58
39

45
30
38
44
41

36
6.
30
12
45
29
49
48
13
51
52
50
37
54
56
57
35
51
11
45
29
30

REFRIGERATION APPARATUS ENCLOSURE STRUCTURE

CROSS-REFERENCE TO RELATED APPLICATION

This application comprises a division of my copending application Ser. No. 433,071, filed Jan. 14, 1974.

BACKGROUND OF THE INVENTION

1. Field of the Invention

This invention relates to refrigeration appliances and in particular to enclosures therefor.

2. Description of the Prior Art

In conventional refrigeration appliance cabinet constructions, an outer metal cabinet is provided having an inner liner which may conventionally be formed of plastic spaced inwardly therefrom to define a space in which is provided suitable insulation. The insulation may be in the form of fiberglass pads and in one improved form, the insulation comprises foamed-in-place insulation. One such foamed-in-place refrigeration apparatus enclosure construction is shown in U.S. Pat. No. 2,962,183 of J. C. Rill, Jr. et al. Such foamed-in-place cabinet constructions are relatively costly as they utilize separate liner elements, relatively costly preparations for the foaming operation, and costly fixtures for accurately retaining the cabinet and liner elements during the foaming operation. The liners are relatively expensive in that they require relatively costly tooling and processing steps, and the cost problems of such conventional foamed-in-place construction are aggravated where a number of different size models must be provided.

One attempted solution to this problem is that shown in U.S. Pat. No. 3,635,536 of Robert Lackey et al., wherein a portable refrigerator is shown as having a low cost cabinet utilizing a foam slab box having integral sides formed of a single sheet of foamed plastic. This patent teaches that if the foamed plastic is formed in a chilled mold process, coating of the inner and outer sides of the sheet may be omitted as the plastic is thusly formed with a thick impervious skin. A similar technique is shown in U.S. Pat. No. 3,014,611 of F. R. Marshall. The box sides are formed from a vee-notched laminate slab which permits folding the laminate to the box configuration. Thus, the laminate forms the outer cabinet, liner and insulation. The notched corners are foamed with fixtures to cement the panels together after the insertion of a sealing gasket.

SUMMARY OF THE INVENTION

The present invention comprehends an improved refrigeration apparatus enclosure construction including an outer cabinet, an inner laminate wall within the outer cabinet defined by an inner sheet liner and outer insulation extending between the inner sheet liner and the outer cabinet, the inner liner having folded corner portions to conform the laminate to the contours of the outer cabinet, the insulation being cut through at the folded portions to define voids outwardly of the folded liner portions, and foamed-in-place insulation means filling the voids.

The invention further comprehends a method of constructing such a refrigeration apparatus enclosure including the steps of fabricating an outer cabinet, providing a flat laminate of sheet liner and insulation, slitting the insulation along lines corresponding to the corners of the outer cabinet, folding the sheet liner at the slits with the sheet liner disposed inwardly, fitting the folded laminate within the outer cabinet with the outwardly disposed insulation confronting the inner surfaces of the cabinet, and securing the laminate to the outer cabinet including foaming plastic in place within the cabinet in the voids formed between the side of the insulation defining said slits resulting from the folding of the sheet liner.

The invention may be utilized to provide a multiple compartment enclosure including a divider wall between a pair of U-shaped laminate walls defining a pair of refrigeration chambers within the cabinet.

The rear wall of the enclosure may comprise a laminate wall with the rear edge of the U-shaped walls butted thereto. The inner sheet liner is effectively spaced from the outer cabinet by the insulation of the laminate wall construction to provide desired insulation between the liner and outer cabinet. The divider wall may be mounted in the manner of a shelf on suitable brackets provided on the U-shaped walls.

The outer insulation of the laminate wall may include an outer vapor barrier portion. The laminate wall insulation may comprise a rigid urethane foam and the inner sheet liner may be formed selectively of plastic or sheet metal as desired. A bead of adhesive sealant may be utilized to seal the seams between the inner sheet liner portions within the enclosure.

Means may be provided for centering the rear laminate wall within the cabinet to provide a preselected spacing around the sheet liner portion thereof relative to the sidewalls, top wall and bottom wall of the cabinet.

Thus, the refrigeration apparatus enclosure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 1:
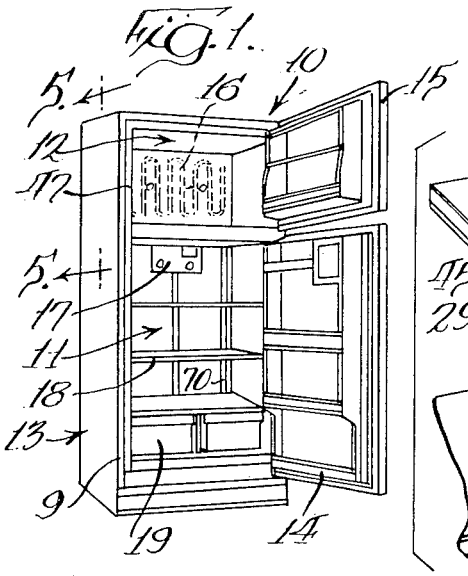
FIG. 1 is perspective view of a refrigeration apparatus having an enclosure embodying the invention.

In the exemplary embodiment of the invention as shown in FIGS. 1–6 of the drawing, a refrigeration apparatus generally designated 10 illustratively comprises a refrigerator defining an above-freezing compartment 11 and a below-freezing compartment 12 defined by an insulated enclosure 13 provided with a pair of doors 14 and 15 for selectively closing chambers 11 and 12. The refrigeration apparatus may include conventional evaporator means 16, control means 17, shelves 18 supported by brackets 70, and drawer means 19. The present invention is concerned with the forming of the insulated enclosures 13 and as will be obvious to those skilled in the art, it may be utilized with other arrangements of refrigeration appliances, the refrigerator-freezer arrangement of FIG. 1 being illustrative only.

Figure 3:
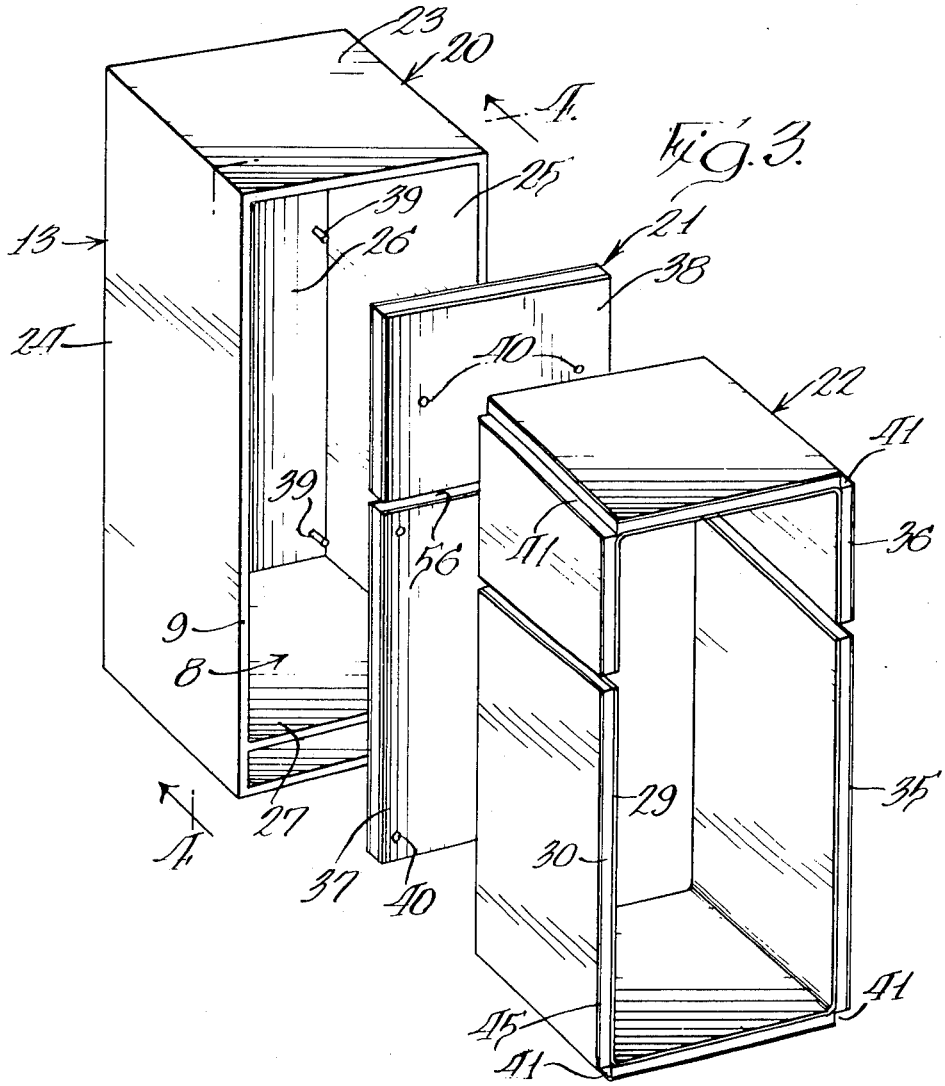
FIG. 3 is an exploded perspective view illustrating the arrangement of the laminate walls in constructing the enclosure of the invention.

Broadly as shown in FIG. 3, the invention comprehends providing an enclosure 13 defined by an outer cabinet generally designated 20, rear wall means generally designated 21, and wall means 22 cooperating with rear wall means 21 to provide an insulative lining of the cabinet. The outer cabinet may be formed in a conventional manner from suitable material, such as metal, to define a forwardly opening box-like construction having a top wall 23, left sidewall 24, right sidewall 25, rear wall 26, bottom wall 27, and a flange 9 extending around the periphery of the front opening 8. Wall means 21 and 22 cooperatively provide an inner sheet liner means and a body of insulation between the inner sheet liner means and outer cabinet to form the completed enclosure 13.

Figure 2:
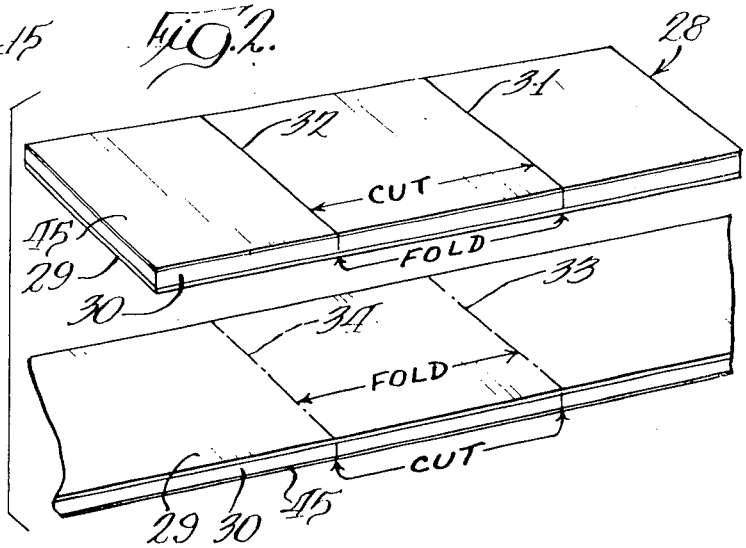
FIG. 2 is a fragmentary perspective view of a pair of laminate sheets illustrating the process of forming the same into laminate wall elements of the enclosure construction.

More specifically, as shown in FIG. 2, the laminate wall means 21 and 22 may be formed from a laminate sheet generally designated 28 defined by a flat sheet liner portion 29 of metal or plastic and a body of insulation 30 bonded between the sheet liner 29 and a thin plastic sheet 45 to form a laminate sandwich which may be provided in continuous length by suitable apparatus (not shown). At spaced intervals, the insulation is cut through such as at slits 31, 32, 33 and 34, permitting the sheet liner 29 to be folded along the insulation slit lines into a pair of U-shaped laminate wall elements 35 and 36 to define the laminate wall means 22. The flat laminate sheet 28 may be cut into discrete portions 37 and 38 to form the rear wall means 21, as shown in FIG. 3. As shown therein, the first laminate wall element 35 defines an upwardly opening U-shaped configuration and the second laminate wall element 36 defines a downwardly opening U-shaped configuration. The U-shaped configuration and slit insulation allow manipulation of the laminate past the flange 9 when inserting the elements into the cabinet 13 through front opening 8.

As further shown in FIG. 3, cabinet rear wall 26 is provided with a plurality of locating support posts 39 and rear laminate wall portions 37 and 38 are provided with a plurality of corresponding openings 40 for receiving the support posts both for locating the rear wall portions 37 and 38 in centered relationship to the walls 23, 24, 25 and 27 of the outer cabinet and for securing the laminate wall portions 37 and 38 to the rear wall 25 of the cabinet.

Figure 4:
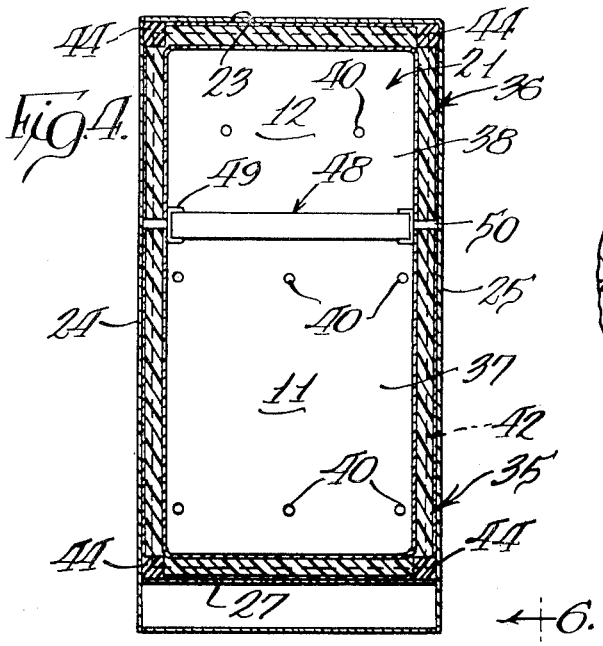
FIG. 4 is a vertical front section of the enclosure substantially along line 4—4 of FIG. 3 after assembly and having a divider wall therein dividing the space within the cabinet into a pair of refrigeration chambers.
Figure 6:
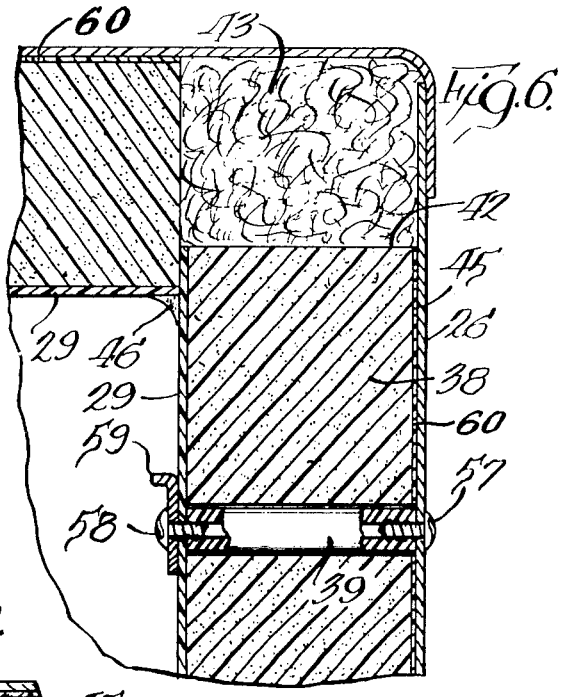
FIG. 6 is a vertical section taken substantially along the line 6—6 of FIG. 5.

As may be seen in FIG. 3, the folded corners of the U-shaped laminate walls 35 and 36 define voids 41. Further, as shown in FIG. 4, as the rear laminate walls 37 and 38 are spaced inwardly from the cabinet walls 23, 24, 25 and 27, respectively, a peripheral void 42 extends fully about the rear laminate wall means 21. In the illustrated embodiment, void 42 is filled with fiberglass insulation 43 as shown in FIG. 6 which may be installed therein prior to the installation of the U-shaped wall elements 35 and 36. Peripheral void 42 may alternatively be filled with foamed-in-place insulation. By utilizing the separate confronting U-shaped elements 35 and 36, different insulation thicknesses in the insulation means of the refrigeration and freezer compartments of the enclosure 13 may be provided. Further, as seen in FIG. 4, laminate wall elements 35 and 36 may be maintained spaced apart to provide a thermal break in the resultant space 50 between the two compartments as shown in FIG. 4, space 50 may be filled with foamed-in-place insulation to bond the laminate walls to the cabinet 13 at this point.

Figure 5:
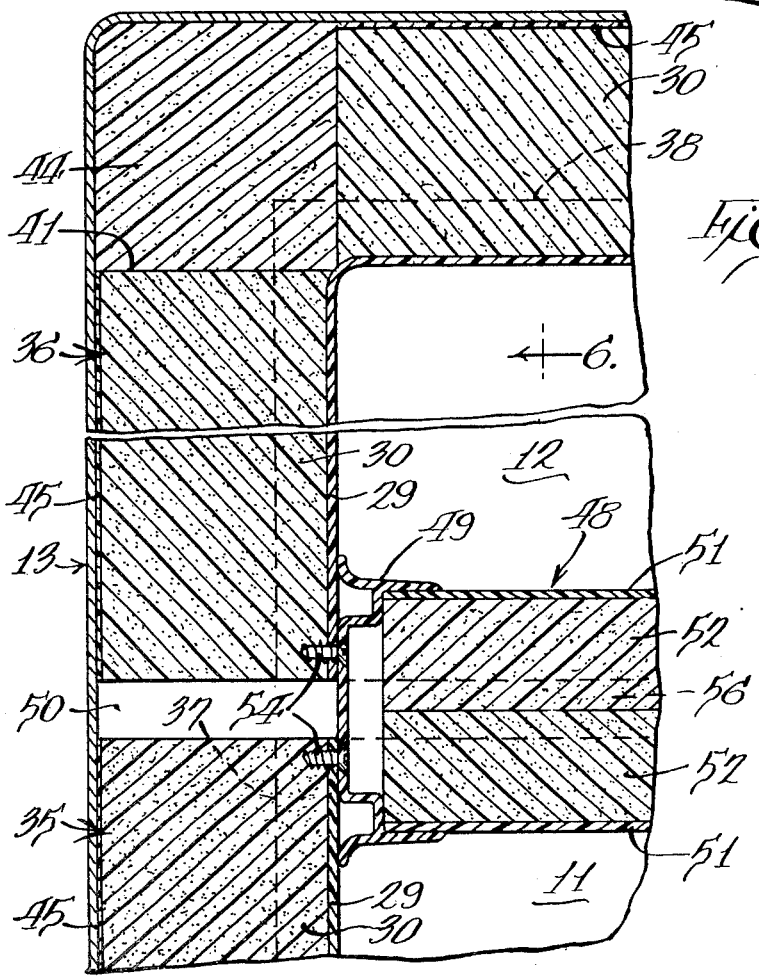
FIG. 5 is a fragmentary enlarged vertical section taken substantially along the line 5—5 of FIG. 1.

As shown in FIG. 5, the voids 41 may be filled with insulation 44. In the illustrated embodiment, insulation 44 comprises foamed-in-place insulation which bonds the laminate walls to the outer cabinet 13 at all four corners of the enclosure.

The laminate walls may further be bonded to the cabinet walls by suitable bonding adhesive 60 as desired. In the illustrated embodiment, the plastic sheet 45 of the laminate walls functions as an outer vapor barrier.

As illustrated in FIG. 6, a bead of flexible adhesive sealant 46 may be laid along the seams between the sheet liner portion of the U-shaped laminate wall elements 35 and 36 and the front surface of the rear laminate wall portions 37 and 38.

Conventional breaker strip gaskets 47 may be assembled onto the U-shaped wall elements 35 and 36 and flange 9 as shown in FIG. 1.

As best seen in FIGS. 4 and 5, the compartments 11 and 12 are separated by a divider wall, or mullion, 48 which is retained between the sidewalls of the enclosure by means of a channel bracket 40 secured to sheet liner 29 of upper U-shaped wall element 36 and sheet liner 29 of lower U-shaped wall element 35 adjacent gap 50 so as to straddle the gap and effectively close the same along the sidewalls of the enclosure. The channel bracket 49 further extends across the rear wall portions 37 and 38 to effectively close the gap 56 between these portions. Divider wall 48, as best seen in FIG. 5, may comprise a pair of laminate walls including a sheet liner portion 51 and insulation portion 52 to define a double laminate sandwich having top and bottom metal or plastic sheet liner wall portions exposed to the chambers 12 and 11, respectively. The bracket may be secured to the liners 29 by suitable fasteners, such as screws, 54.

While the divider wall 48 effectively covers the gap 56 between the rear wall portions 37 and 38 as well as the gap 50 along the sidewalls of the enclosure, the top chamber 12 is effectively thermally insulated from the lower chamber 11 by the break in the laminate wall means.

Figure 7:
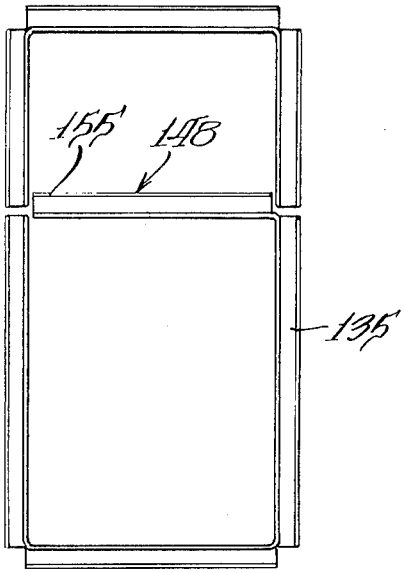
FIG. 7 is a front elevation illustrating the form of laminate wall arrangement for use in a side-by-side refrigerator-freezer.

The form of the laminate structure for a side-by-side refrigerator-freezer is shown in FIG. 7. In this embodiment, the two U-shaped elements are horizontally opposed with element 235 in the above-freezing compartment and element 236 in the below-freezing compartment. Divider wall 248 separates the two compartments. The foam is applied in the voids 241.

Figure 8:
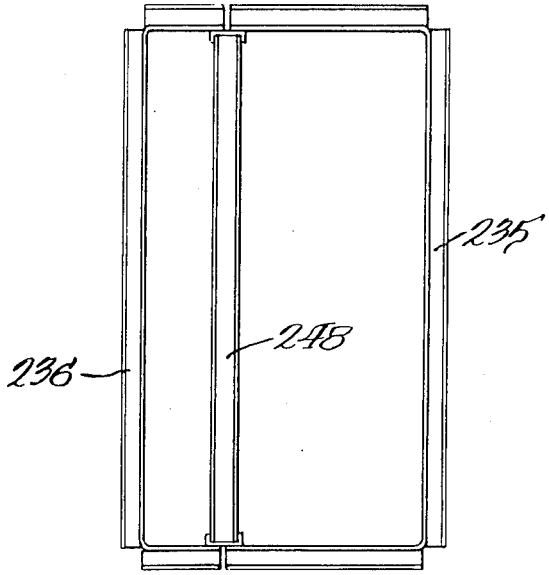
FIG. 8 is a front elevation illustrating the form of laminate wall arrangement for use in a vertical freezer.

For vertical freezers the form of the laminate is shown in FIG. 8, wherein U-shaped element 336 conforms to the top and sides of the cabinet and portion 335 covers the bottom of the cabinet. The foam is applied in the voids 341.

Figure 9:
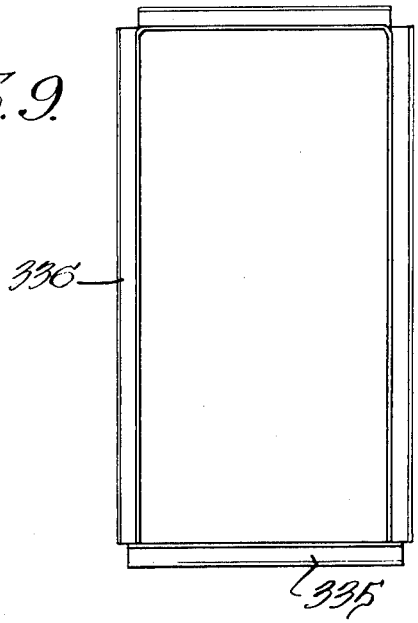
FIG. 9 is a front elevation illustrating a modified form of laminate wall for use in a refrigerator-freezer.

A modified form of the invention is illustrated in FIG. 9 for a refrigerator-freezer similar to the refrigerator-freezer of FIG. 1. In this form, separate laminate portions 434, 435, 436, 437 are utilized to conform to the top, sides and bottom of the cabinet by forming corner portions having voids 441. A divider 448 is provided to separate the interior into two compartments. Foam is utilized to fill the voids 441 and to adhere the laminate portions to the cabinet. Foam may also be utilized to fill the voids 442 for more stability of the laminate portions.

The mounting posts 39 for locating and mounting the rear wall portions 37 and 38 may comprise plastic posts secured to the outer cabinet by suitable fastening means such as screws 57 and to the inner sheet liner 29 of the rear laminate wall portions by suitable means such as screws 58. The screws 58 may further serve to mount support brackets 59 to the sheet liner as for carrying the evaporator 16 in the enclosure.

Thus the invention comprehends an improved simplified method of constructing a refrigeration apparatus enclosure wherein a plurality of flat laminates defining an inner sheet liner and an outer insulation are provided. The laminates are folded to conform to the internal configuration of the cabinet after firstly slitting the insulation along the desired fold lines with the laminate elements being firstly cut from a continuous low cost laminate stock material. As indicated above, the stock material may include a vapor barrier as an outer portion of the insulation.

The use of the laminate construction permits adaptation of the internal construction of the enclosure to a wide variety of sizes and shapes of the refrigeration appliance enclosure. As the insulation means of the laminates effectively positions the liner portion in spaced relationship to the cabinet, free foaming of the corner bonding portions may be effected without the need for expensive fixtures and expensive setups or for the use of additional adhesive means. The enclosure arrangement is adapted for use with either hermetic or component hook-up refrigeration systems while yet providing the improved low cost construction of the insulated enclosure. As indicated above, adhesive means, such as adhesive 60, may be utilized to secure the laminate walls to the cabinet walls if desired, although as indicated above, the foamed-in-place insulation effectively bonds the laminate walls to the outer cabinet effectively eliminating the need for the additional adhesive means 60 and thus effectively minimizing cost.

The foregoing disclosure of specific embodiments is illustrative of the broad inventive concepts comprehended by the invention.

I claim:

1. In a refrigeration apparatus enclosure having an outer cabinet having walls defining a corner, an improved corner construction comprising: inner laminate wall means within said outer cabinet defined by an inner sheet liner and outer insulation extending between said inner sheet liner and said outer cabinet, said inner laminate wall means having an intersecting corner portion wherein the inner sheet liner portions are in overlapping abutment adjacent said corner of said outer cabinet, said corner portion defining a void outwardly of said inner sheet liner portions and inwardly of said outer cabinet corner; and foamed-in-place insulation means filling said void and contacting said outer cabinet corner and at least one portion of said inner sheet liner.

2. The refrigeration apparatus enclosure of claim 1 wherein said wall means comprises two intersecting laminate walls.

3. The refrigeration apparatus enclosure of claim 1 wherein said wall means comprises two intersecting laminate walls, said void defining a rectangular cross section having a long dimension substantially equal to the thickness of one laminate wall and a short dimension substantially less than the thickness of the other intersecting laminate wall.

4. The refrigeration apparatus enclosure of claim 1 wherein said cabinet defines a plurality of corners and said corner construction comprises one of a plurality of spaced similar corner constructions one each at different cabinet corners.

5. The refrigeration apparatus enclosure of claim 1 wherein said foamed-in-place insulation further serves to bond the inner laminate wall means to the outer cabinet.

6. The refrigeration apparatus enclosure of claim 1 wherein said foamed-in-place insulation filling said void contacts said outer insulation portions of said laminate wall corner portion.

7. The refrigeration apparatus enclosure of claim 1 wherein said void defines a rectangular cross section having a long dimension substantially equal to the thickness of one laminate wall and a short dimension substantially less than the thickness of the other intersecting laminate wall.

8. The refrigeration apparatus enclosure of claim 1 further including means for sealing the intersection of said corner portions inwardly of the intersecting sheet liners thereof.

9. The refrigeration apparatus enclosure of claim 8 wherein said sealing means comprises flexible adhesive sealant material.

* * * * *